US009995159B2

(12) United States Patent
Verhelst

(10) Patent No.: US 9,995,159 B2
(45) Date of Patent: Jun. 12, 2018

(54) BLADE RETAINING RING FOR AN INTERNAL SHROUD OF AN AXIAL-FLOW TURBOMACHINE COMPRESSOR

(71) Applicant: Techspace Aero S.A., Herstal (Milmort) (BE)

(72) Inventor: Damien Verhelst, Liège (BE)

(73) Assignee: SAFRAN AERO BOOSTERS SA, Herstal (Milmort) (BE)

( * ) Notice: Subject to any disclaimer, the term of this patent is extended or adjusted under 35 U.S.C. 154(b) by 259 days.

(21) Appl. No.: 14/695,292

(22) Filed: Apr. 24, 2015

(65) Prior Publication Data

US 2015/0308277 A1 Oct. 29, 2015

(30) Foreign Application Priority Data

Apr. 24, 2014 (EP) ..... 14165800

(51) Int. Cl.
*F01D 9/04* (2006.01)
*F01D 11/00* (2006.01)
(Continued)

(52) U.S. Cl.
CPC ..... *F01D 9/04* (2013.01); *F01D 9/042* (2013.01); *F01D 11/001* (2013.01);
(Continued)

(58) Field of Classification Search
CPC ..... F01D 11/001
See application file for complete search history.

(56) References Cited

U.S. PATENT DOCUMENTS 6,223,524 B1 * 5/2001 Durcan ..... F01D 5/225 415/173.6
2004/0145251 A1 * 7/2004 Clouse ..... F01D 5/26 310/51
(Continued)

FOREIGN PATENT DOCUMENTS

EP 1079075 A2 2/2001
EP 2075415 A1 * 7/2009 ..... F01D 5/26
(Continued)

OTHER PUBLICATIONS

Search Report dated Oct. 28, 2014 from European Patent Appl. No. 14105800.5.

*Primary Examiner* — Woody Lee, Jr.
*Assistant Examiner* — Theodore Ribadeneyra
(74) *Attorney, Agent, or Firm* — James E. Walton

(57) ABSTRACT

A stator of a low-pressure compressor of an axial-flow turbomachine. The stator includes an annular row of stator blades including radial extremities which pass through the openings of an internal shroud, and which include radial retaining slots having tapers formed by hooks. The stator includes a ring for retaining the blades on the internal shroud. The ring is curved circumferentially in order to be inserted into a plurality of retaining slots and exhibits the form of a strip having an arched transversal profile which is in abutment against the tapers, in such a way as to maintain the ring in the interior of the slots. The shroud includes an annular layer of abradable material made from silicone, which encloses the ring in such a way as to block the curvature of the arched profile of the ring in order to prevent it from disengaging from the tapers of the slots.

20 Claims, 2 Drawing Sheets

(51) Int. Cl.

| | |
|---|---|
| ***F01D 25/00*** | (2006.01) |
| ***F04D 19/00*** | (2006.01) |
| ***F04D 29/16*** | (2006.01) |
| *F01D 11/12* | (2006.01) |

(52) U.S. Cl.
CPC ..... *F01D 25/005* (2013.01); *F04D 19/007* (2013.01); *F04D 29/164* (2013.01); *F01D 11/122* (2013.01); *F05D 2250/71* (2013.01); *F05D 2260/30* (2013.01); *F05D 2260/36* (2013.01); *F05D 2300/171* (2013.01); *F05D 2300/43* (2013.01); *F05D 2300/437* (2013.01); *F05D 2300/501* (2013.01)

(56) References Cited

U.S. PATENT DOCUMENTS

| | | | | |
|---|---|---|---|---|
| 2006/0222487 | A1* | 10/2006 | Au | F01D 9/04 415/174.4 |
| 2010/0067979 | A1* | 3/2010 | Fayollas | F16C 11/12 403/225 |
| 2012/0141253 | A1* | 6/2012 | Weidmann | F01D 5/225 415/1 |
| 2013/0108427 | A1* | 5/2013 | Brassine | B29C 45/16 415/200 |
| 2013/0119617 | A1* | 5/2013 | Alvanos | F01D 11/001 277/628 |
| 2013/0202408 | A1* | 8/2013 | Laurello | F01D 5/087 415/115 |

FOREIGN PATENT DOCUMENTS

| | | | | |
|---|---|---|---|---|
| EP | 2204539 | A2 | 7/2010 | |
| GB | 748912 | A * | 5/1956 | F01D 9/042 |

* cited by examiner

BLADE RETAINING RING FOR AN INTERNAL SHROUD OF AN AXIAL-FLOW TURBOMACHINE COMPRESSOR

This application claims priority under 35 U.S.C. § 119 to European Patent Application No. 14165800.5, filed 24 Apr. 2014, titled "Blade Retaining Ring for an Internal Shroud of an Axial-Flow Turbomachine Compressor," which is incorporated herein by reference for all purposes.

BACKGROUND

1. Field of the Application

The present application relates to a stator of an axial-flow turbomachine compressor. More specifically, the present application relates to a stator having a ring for the retention of the blades of an axial-flow turbomachine. The present application also relates to an axial-flow turbomachine.

2. Description of Related Art

In order to delimit an annular flow, the stator of an axial-flow turbomachine is generally provided with coaxial shrouds delimiting the interior and the exterior of the flow. The stator also comprises an annular row of blades extending radially between the shrouds. The blades may be inserted into openings provided in a shroud, and they may be maintained in an individual manner on the shroud in question.

The retention may be achieved with the help of a retaining ring which interacts with slots formed in extremities of blades situated beyond the shroud, outside the flow.

Document GB 748,912 A discloses an assembly of blades on a shroud of a compressor of an axial-flow turbomachine. The shroud comprises two annular walls having openings for the insertion of extremities of blades. Each blade exhibits a free extremity, extending radially on the exterior of the shroud, which includes a retaining slot. The slots of the blades exhibit a narrowing towards the exterior. The slots are positioned in rows and receive blade retaining rings of which the transversal profile is arched. When positioned in this way, the rings form edges which block the blades.

However, a blade may be subjected to high tensile loadings that are capable of disassociating a blade from its ring. In fact, in the event of tensile loading, the inclined edges of a slot may crush the ring by causing it to arch further, so that the ring may exit from the slot. The blade concerned is then no longer retained by its ring Although great strides have been made in the area of blade retention in axial turbomachine compressors, many shortcomings remain.

DETAILED DESCRIPTION OF THE PREFERRED EMBODIMENT

Figure 1:
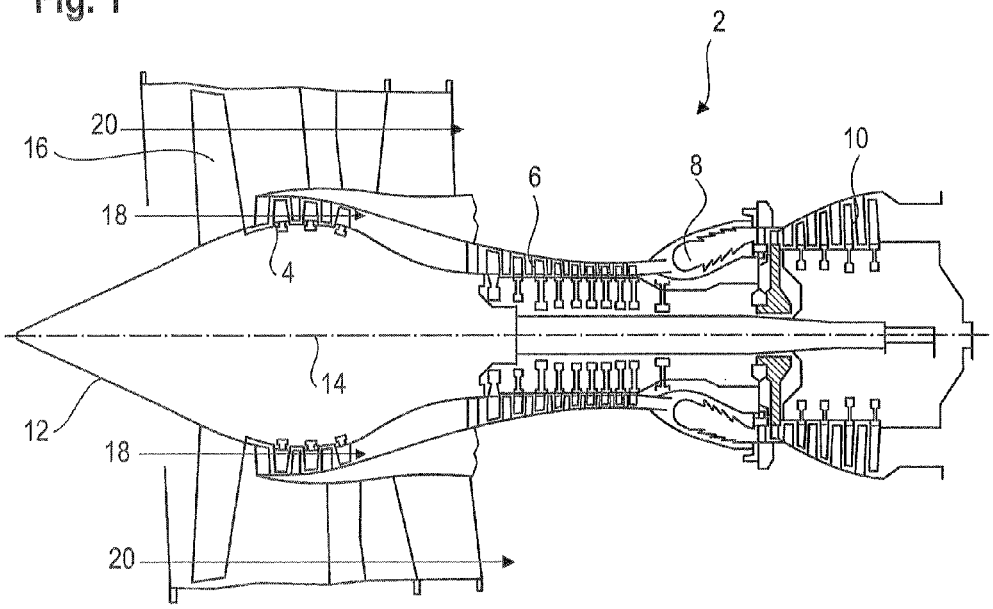
FIG. 1 depicts an axial-flow turbomachine according to the present application.

The present application aims to resolve at least one of the problems posed by the prior art. More specifically, the present application has as its object to improve the retention between a blade and a ring having an arched transversal profile of an axial-flow turbomachine. The present application also has as its object to increase the service life of a rotor having blades retained on a shroud with the help of a ring.

The present application has as its object a stator of an axial-flow turbomachine, in particular a compressor, the stator comprising a shroud having an annular row of openings, an annular row of stator blades which extend essentially radially by passing through the openings (36), each blade including a retaining slot (38) and a blade leaf intended to extend into a flow of the turbomachine, each retaining slot including an inlet having a taper and being situated on the other side of the blade leaf in relation to the opening passed through by the corresponding blade, at least one blade retaining ring being inserted into the slots, the ring exhibiting the form of a strip having an arched transversal profile which is in contact with the tapers in such a way as to maintain the ring in the slots, characterized in that the shroud comprises a layer of abradable material enclosing the transversal profile of the ring in such a way as to block the curvature of the arched transversal profile in order to prevent the ring from exiting from the tapers of the slots by being deformed.

According to one advantageous embodiment of the present application, the ring is curved circumferentially in such a way as to be parallel to the shroud, the ring being situated at a distance radially from the openings of the shroud.

According to one advantageous embodiment of the present application, in the absence of the layer of abradable material, the ring is configured so as to be introduced into and/or removed from the slots by flattening or by further arching its arched profile, the deformation possibly being a plastic deformation of the ring.

According to one advantageous embodiment of the present application, the ring is a spring configured so as to be capable of deforming elastically over at least 5%, and preferably at least 10%, of its axial length and/or of its radial height, the ring being made from spring steel, preferably from 45S7, 55S7, 45SCD6, 60SC7, 45SW8, 45C4, 50CV4 grade steel.

According to one advantageous embodiment of the present application, axially in the area of the ring, the radial majority of the layer of abradable material is positioned between the shroud and the ring.

According to one advantageous embodiment of the present application, the thickness of the strip of the ring is less than 1 mm, preferably less than 0.25 mm, and more preferably less than 0.1 mm.

According to one advantageous embodiment of the present application, the arched transversal profile of the ring describes between one tenth of a circle and a semi-circle, preferably between one sixth and one third of a circle, and more preferably between one fifth and one quarter of a circle.

According to one advantageous embodiment of the present application, the arched transversal profile of the ring exhibits a principal elongation that is generally parallel to the axis of rotation of the axial-flow turbomachine.

According to one advantageous embodiment of the present application, the layer of abradable material is an annular layer which covers the two faces of the strip of the ring, and the ring is surrounded by the layer of abradable material for the entire length of the intervals between the blades, the layer of abradable material also filling the openings of the shroud around the blades.

According to one advantageous embodiment of the present application, the slots are radially open, the radial depths of the slots being greater than the radial height of the ring.

According to one advantageous embodiment of the present application, each slot comprises two axially opposing hooks, which close the passage in the slot in such a way as to permit the radial retention of the ring.

According to one advantageous embodiment of the present application, the shroud is an internal shroud, the shroud and the ring being segmented, each segment of the shroud comprising at least three openings for the insertion of blades.

According to one advantageous embodiment of the present application, the ring comprises a curved surface with respect to the shroud, the ring preferably comprising two circular edges projecting radially and being positioned radially on the side of the shroud.

According to one advantageous embodiment of the present application, the layer of abradable material comprises a resilient material, including elastomer or silicone, with which it has possibly been charged, and is intended to interact by abrasion with the rotor of the axial-flow turbomachine.

According to one advantageous embodiment of the present application, the ring is a strip of material of constant arched and curved thickness.

According to one advantageous embodiment of the present application, the tails of the slots move closer to one another radially towards the interior.

According to one advantageous embodiment of the present application, the width of the slots is reduced radially towards the interior.

According to one advantageous embodiment of the present application, the arched shape of the transversal profile forms a thickening of the strip, and/or forms a reduction in the transversal width of the ring.

The ring exhibits a principal elongation in the circumferential direction of the stator, the transversal direction being perpendicular to the circumferential direction.

According to one advantageous embodiment of the present application, the layer of abradable material is glued or adheres to the ring.

According to one advantageous embodiment of the present application, the layer of abradable material encloses the blades.

According to one advantageous embodiment of the present application, the layer of abradable material forms a block of material around the transversal profile of the ring.

According to one advantageous embodiment of the present application, the layer of abradable material exhibits a constant radial thickness and/or a constant axial length between the blades.

According to one advantageous embodiment of the present application, the slots are radial retaining slots.

According to one advantageous embodiment of the present application, the ring may be deformed axially in compression in such a way as to further arch its arched profile in order to permit the introduction or the removal of the ring in the absence of the layer of abradable material.

According to one advantageous embodiment of the present application, the shroud is capable of delimiting an axial annular flow of the turbomachine, the blade leaves being intended to extend radially into the annular flow, where appropriate by deviating from it.

According to one advantageous embodiment of the present application, the layer of abradable material prevents the ring from exiting from the tapers of the slots by modifying the curvature of the arched transversal profile.

The present application also relates to an axial-flow turbomachine comprising a stator, characterized in that the stator is consistent with the present application, the turbomachine preferably comprising a low-pressure compressor equipped with a stator that is consistent with the present application.

The proposed architecture of the stator brings synergy between the layer of abradable material and the ring. The layer of abradable material improves the stability of the ring by locking its curvature, thereby guaranteeing its retention. The ring is best secured in position in the slots, against the tapers. The ring makes it possible to improve the mechanical connection between the blades and the layer of abradable material. The presence of the layer of abradable material between the shroud and the ring favors the distribution of the forces at that point, by forming a cushion to absorb the peaks of any stresses arising in the event of shocks. In this way, the radial retention of the blades to the shroud is more secure. The function of locking the layer of abradable material may be achieved by any polymer material, possibly a composite, the abradable function being optional.

The service life of such a stator is improved because the anchorage produced in this way is no longer dependent solely on the cohesion between the blade and the abradable material. In the event of shock involving the ingestion or detachment of a fan blade, the blades will be better able to remain attached to their shroud.

In the following description, the expressions interior or internal and exterior or external refer to a position in relation to the axis of rotation of an axial-flow turbomachine.

FIG. 1 is a simplified representation of an axial-flow turbomachine. The turbomachine in question in this particular case is a turbofan engine. The turbofan engine 2 comprises a first level of compression, known as the low-pressure compressor 4, a second level of compression, known as the high-pressure compressor 6, a combustion chamber 8 and one or a plurality of turbine levels 10. In operation, the mechanical power of the turbine 10 transmitted via the central shaft as far as the rotor 12 sets the two compressors 4 and 6 in motion. Reduction means may increase the speed of rotation transmitted to the compressors. Each of the different turbine stages may also be connected to the compressor stages via concentric shafts. The latter include a plurality of rows of rotor blades associated with rows of stator blades. The rotation of the rotor about its axis of rotation 14 thus makes it possible to produce an air flow and to compress the latter progressively as far as the inlet into the combustion chamber 10.

An inlet ventilator commonly referred to as a fan or blower 16 is connected to the rotor 12 and produces a flow of air which is divided into a primary flow 18 passing through the different above-mentioned levels of the turbomachine, and a secondary flow 20 passing through an annular duct (depicted partially) along the machine before subsequently rejoining the primary flow at the outlet from the turbine. The secondary flow may be accelerated in such a way as to generate a thrust reaction. The primary flow 18 and the secondary flow 20 are annular flows, and they are channelled via the casing of the turbomachine, and they are able to circulate axially. For this purpose, the casing exhibits cylindrical walls or shrouds which may be internal and external.

Figure 2:
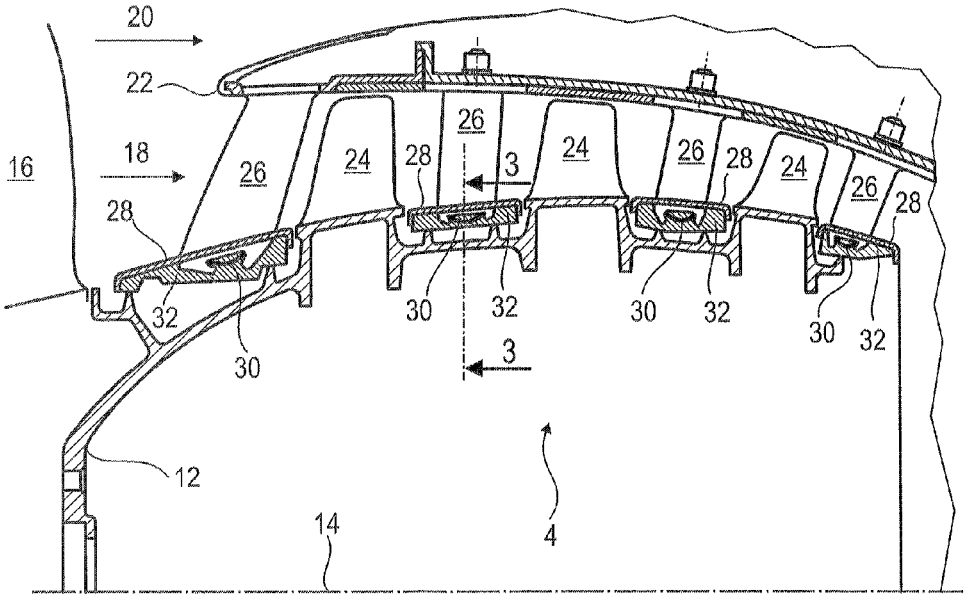
FIG. 2 is a diagram of a compressor of a turbomachine according to the present application.

FIG. 2 is a view in cross section of a compressor of an axial-flow turbomachine 2 such as that depicted in FIG. 1. The compressor may be a low-pressure compressor 4. A part of the fan 16 and the lip 22 for the separation of the primary flow 18 and of the secondary flow 20 may be observed here.

The rotor 12 comprises a plurality of rows of rotor blades 24, being three in number in this particular case.

The low-pressure compressor 4 comprises a stator having a plurality of rectifiers, being four in number in this particular case, each of which contains an annular row of stator blades 26. The rectifiers are associated with the fan 16 or with a row of rotor blades in order to rectify the flow of air, in such a way as to convert the flow velocity into pressure. The stator blades 26 extend essentially radially from an exterior stator casing, and they may be secured there with the help of a pin, such as a dowel, or a lock bolt. The stator casing may be an external shroud.

The stator comprises at least one shroud 28, for example an internal shroud 28, enabling guiding of the primary flow 18. The stator may comprise a plurality of shrouds, for example a plurality of internal shrouds. Each shroud 28 exhibits an annular row of openings. The latter are distributed in a homogeneous manner around the periphery of the internal shrouds and are passed through by the extremities of the blades for the purpose of their anchorage. Each shroud may comprise an annular wall, which is generally tubular or substantially conical, and possibly one or two annular flanges positioned at the axial extremities of the annular wall. Each annular flange extends radially towards the interior or the exterior. The shrouds 28 may be made from metal, for example from an alloy of titanium, or from a composite material in order to reduce their mass. The shrouds form mechanical linkages between the blades.

The stator comprises at least one or a plurality of rings 30 for the retention of blades 26. Each ring 30 is introduced into slots formed at the extremities of the blades, for example the internal extremities situated radially beneath the internal shrouds. The stator may comprise a plurality of rings 30, each being associated with an annular row of blades, in order to retain the blades of the row radially on the associated shroud.

The stator comprises at least one or a plurality of layers of material 32 associated with at least one shroud. At least one or each layer of material may be a layer of abradable material 32, or a layer of friable material, accommodated in the hollow of the internal shrouds 28. At least one or each layer may be annular. The layers of abradable material 32 may be of substantially constant thicknesses, in such a way as to form a strip. These layers of abradable material 32 are intended to interact by abrasion with rotor seals, or circumferential fins, in such a way as to ensure a seal, for example a dynamic seal. The layers of abradable material 32 ensure an airtight fill and may be structural. Each layer of abradable material may provide cushioning. Each layer of abradable material may adhere to a ring, and/or to a shroud, and/or to a blade. During operation of the turbomachine, the rotor is displaced and is deformed in such a way that the radial extremities of the seals skim the associated layers of abradable material. They may produce annular furrows there.

The one or each shroud 28 may be formed from a plurality of annular segments, which form angular sectors of circles. The ring 30 may also be segmented, in the same way as the layer of abradable material 32. The annular segments exhibit an arched shape. They each exhibit a plurality of openings, into which interior extremities of the stator blades 26 are introduced. For example, each annular segment may be connected to at least three blades, and possibly four blades.

Figure 3:
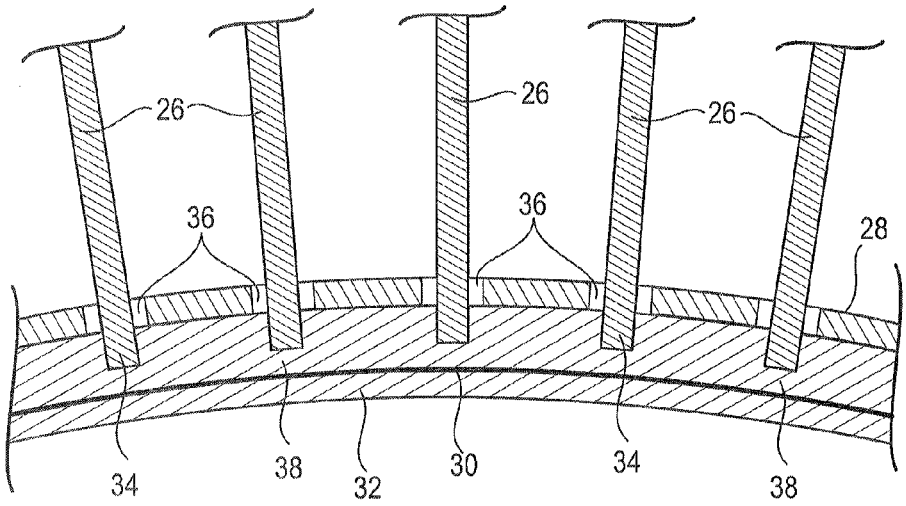
FIG. 3 illustrates a section along the axis 3-3 indicated in FIG. 2 of a stator of a turbomachine according to the present application.

FIG. 3 depicts a stator of an axial-flow turbomachine having a series of stator blades 26 connected to a shroud 28 via a retaining ring 30 and a layer of abradable material 32. The stator is depicted according to a section along the axis 3-3 indicated in FIG. 2. The present approach may be applied to an internal shroud as well as to an external shroud.

The extremities 34, for example internal, of the blades 26 pass through the openings 36 of the shroud 28. Each opening 36 may adopt the form of the associated blade, or may constitute a free space around the blade 26. The free space may be filled by the layer of abradable material 32, or by an additional silicone joint (not depicted) in order to assure sealing in the joint. Each blade 26 may exhibit a continuity of the profile on the two sides of the shroud 28. In addition to the continuities of profile, the extremities 34 of the blades comprise the retaining slots 38. These slots 38 engage, for example by positive contact, with their associated ring 30. The blades comprise blade leaves positioned in the flow, and extremities radially opposite the blade leaves in relation to the shrouds. The shroud separates the extremities of the blade leaves positioned in the flow.

The ring 30 may have the form of a strip having two faces. Each face may be covered by the layer of abradable material 32. Each blade may comprise a main portion, and an extremity 34. The main portion is radially the higher, and may form a leaf extending in the primary flow. The extremity 34 may be a fixation portion. The ring 30 may be enclosed by the layer of abradable material 32 between each extremity 34 of a blade 26, or along the entire length of the shroud. The ring 30 may be curved in such a way as to border the internal annular surface or the external annular surface of the associated shroud 28. The ring 30 may remain at a distance radially from the annular surface of the shroud 28. In this way, a part of the layer of abradable material 32 may be positioned between the shroud 28 and the ring 30. Axially in the area of the ring 30, the majority of the radial thickness of the layer of abradable material may possibly be situated between the shroud and the ring.

The space between the ring 30 and the shroud 28 is advantageously occupied by the layer of abradable material 32. The layer of abradable material may be in contact with the shroud and the ring. There is thus a better distribution of the forces between the ring 30 and the shroud 28, and accordingly between the blades 26 and the shroud 28. The stress concentrations are reduced, which improves the service life of the shroud 28, and/or allows it to be slimmed down with a view to lightening it. The ring 30 may form a reinforcing core for the shroud 28. The shroud 28 may form a support for the layer of abradable material 32, and/or a protective skin covering the layer of abradable material 32.

The layer of abradable material 32 may comprise an elastomer, of which the viscoelastic character, combined with the presence of the ring 30, improves the cushioning effect in the presence of vibrations in the stator. The layer of abradable material 32 may adhere to the blades 26, and/or to the shroud 28, and/or to the ring 30. Adhesive may be applied to the ring 30 in order for it to adhere to its environment. The layer of abradable material 32 may be silicone, possibly together with spheres in order to improve the friability.

The material of at least one or each ring 30 may be a metal. The metal may be mangano-siliceous steel, for example with 1.5% to 2% of silicon, for example with 0.6% to 0.7% of manganese, 0.4% to 0.6% of carbon. The metal or the steel may contain chromium, and/or tungsten, and/or molybdenum and/or vanadium. The steel may be of the type 45S7, 55S7, 45SCD6, 60SC7, 45SW8, or 45C4, 50CV4. The metal may also be copper with 1% to 2% of beryllium. The percentages are percentages by weight.

Figure 4:
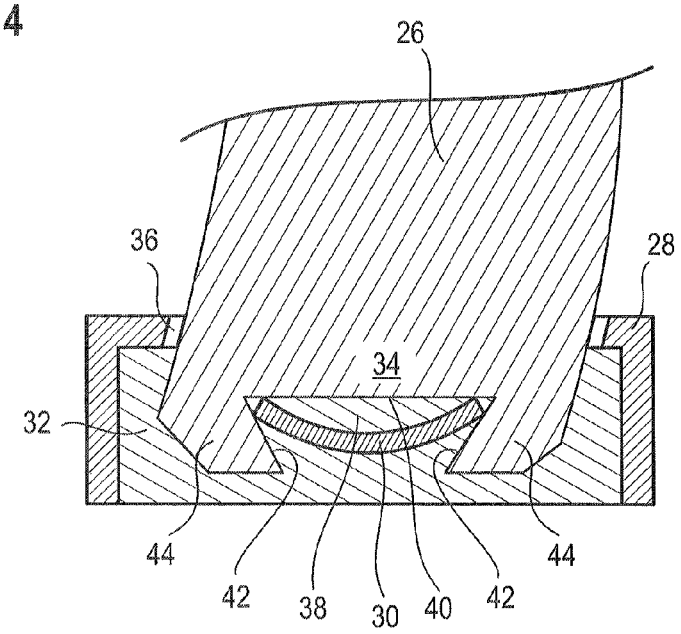
FIG. 4 outlines an extremity of a blade mounted in a shroud according to the present application.

FIG. 4 depicts an enlargement of a stator with a radial extremity 34 of a blade secured to a shroud 28 by means of a ring 30 encapsulated in a layer of abradable material 32 applied inside the shroud.

The extremity 34 of the blade 26 passes through the shroud 28 and extends beyond the shroud, on the side opposite the fluid stream. The extremity 34 may be a fixation extremity and comprises a retaining slot or anchorage slot 38. The slot 38 may be oriented axially or radially. The expression oriented may be used to denote open. A slot may extend predominantly axially and may be radially open. The slot 38 may form a cut-out in the extremity 34 of the blade 26. The retention slot 38 delimits a space, into which the ring 30 is integrated in order to ensure its retention.

The slot 38 includes an inlet via which the ring may be introduced or withdrawn, and a base 40 opposite the inlet. The slot may exhibit a taper or narrowing. The taper may be formed between the inlet and the base 40 and may be progressive. It forms a reduction in the width of the passage in relation to the inlet. The slot 38 may comprise two tails 42 joining the inlet and the base 40. The tails 42 may move closer to one another in such a way as to form the taper. The extremity 34 of the blade may comprise two hooks 44 in such a way as to form the taper. They may move closer to one another locally. The taper is axial, because the slot 38 is open radially. It may be radial in the case of an axially open slot.

The ring 30 has the form of a strip or ribbon, of which the principal elongation follows the circumference of the shroud 28. The transversal profile of the strip is arched, and it exhibits a curved shape. The curved appearance permits the transversal width of the ring 30 to be reduced and/or its thickness to be increased, the thickness being perpendicular to the elongation and to the transversal direction. The profile of the ring 30 exhibits a principal elongation. This principal elongation may be oriented radially or axially, for example depending on the orientation of the taper and its retention function. The ring, or at least its strip, is essentially fine. Its thickness is less than 1.00 mm and is possibly less than 0.25 mm.

The arched shape of the profile transversal describes a fraction of a circle, and possibly more than one turn. The profile may describe a portion of a curve or of a circle between 180° and 30°, preferably between 120° and 60°, and more preferably between 90° and 72°. The arched shape comes into contact with the taper in such a way as to ensure the retention of the ring in the slot, and it may also be in contact with the base of the slot. The ring 30 may include a concave surface with respect to the shroud, thereby enabling a part of the layer of abradable material to be confined with the shroud.

The arched shape makes it possible to increase the overall dimensions of the profile of the ring 30. It may thus offer a greater contact surface for the retention of a blade. In addition to its arched aspect, the strip may have a constant thickness. The arched transversal profile of the ring 30 exhibits relative flexibility, which allows it to be introduced into the slot 38 by crushing it. It may be crushed transversally or axially in order to enter into the slot, for example by being deformed plastically. The ring may also be a spring which is deformed elastically when it is introduced into the slot. It is deformed elastically, radially or axially by more than 5%, and preferably by more than 10% of the dimension concerned.

In order to prevent inverse deformation, the ring 30 is retained by the layer of abradable material 32. The layer of abradable material 32 encloses the profile, for example all the way round the transversal profile. This layer of abradable material 32 may exhibit a thickness that is greater than half of the radial thickness of the shroud 28. It may block the curvature of the profile in order to lock the ring 30 in the slot 38, so as to prevent it from exiting in the event of the ring being pulled out of the slot following its deformation. This deformation may then increase the curvature of the arc, or may flatten it depending on the orientation of the curvature in relation to the taper.

The characterizing features presented above are detailed for a shroud and/or for a ring, and/or for a layer of abradable material, and/or for a slot. However, each characterizing feature may apply to all the shrouds and/or to all the rings, and/or to all the layers of abradable material, and/or to all the slots in the stator of the turbomachine, or also to the majority thereof.

I claim:

1. A stator of an axial-flow turbomachine, comprising:

a circumferential direction;

a shroud having an annular row of openings;

an annular row of stator blades which extend essentially radially by passing through the openings, each blade comprising:

a main portion being a blade leaf radially extending in a flow of the turbomachine from the shroud; and a fixation extremity with a retaining slot, each retaining slot of blade fixation extremity including an inlet having a taper and being situated on the other side of the blade leaf in relation to the opening passed through by the corresponding blade;

at least one retaining ring for blades inserted into the slots, the ring exhibiting the form of a strip having an arched transversal profile which is transversal with regard to the circumferential direction and which is in contact with the tapers in such a way as to maintain the ring in the slots;

wherein the shroud comprises:

a layer of abradable material with a transversal profile encircling the transversal profile of the ring in such a way as to block the curvature of the arched transversal profile in order to prevent the ring from exiting from the tapers of the slots by being deformed.

2. The stator according to claim 1, wherein the ring is curved circumferentially in such a way as to be parallel to the shroud, the ring being situated at a distance radially from the openings of the shroud, and the layer of abradable material radially separates the transveral profile of the ring from the shroud.

3. The stator according to claim 1, wherein in the absence of the layer of abradable material, the ring is configured so as to be introduced into and/or removed from the slots by flattening or by further arching the arched profile thereof, the deformation optionally being a plastic deformation of the ring.

4. The stator according to claim 1, wherein the ring is a spring configured so as to be capable of deforming elastically over a defromation range of the axial length thereof and/or the radial height thereof, the ring being made from spring steel chosen from the following group: 45S7, 55S7, 45SCD6, 60SC7, 45SW8, 45C4, and 50CV4 grade steel, the deformation range being one of the following:

at least 5%; and at least 10%.

5. The stator according to claim 1, wherein, axially in the area of the ring the radial majority of the layer of abradable material is positioned between the shroud and the ring.

6. The stator according to claim 1, wherein the thickness of the strip of the ring is chosen from one of the following:
less than 1 mm;
less than 0.25 mm; and
less than 0.1 mm.

7. The stator according to claim 1, wherein the arched transversal profile of the ring describes between one tenth of a circle and a semi-circle, preferably between one sixth and one third of a circle, and more preferably between one fifth and one quarter of a circle.

8. The stator according to claim 1, wherein the arched transversal profile of the ring exhibits a principal elongation that is generally parallel to the axis of rotation of the axial-flow turbomachine.

9. The stator according to claim 1, wherein the layer of abradable material is an annular layer which covers the two faces of the strip of the ring, and the ring is surrounded by the layer of abradable material for the entire length of the intervals between the blades, the layer of abradable material also filling the openings of the shroud around the blades.

10. The stator according to claim 1, wherein the slots are radially open, the radial depths of the slots being greater than the radial height of the ring.

11. The stator according to claim 1, wherein each slot comprises:
two axially opposing hooks, which close the passage in the slot in such a way as to permit the radial retention of the ring.

12. The stator according to claim 1, wherein the shroud is an internal shroud, the shroud and the ring being segmented, each segment of the shroud comprising:
at least three openings for the insertion of blades.

13. The stator according to claim 1, wherein the ring comprises:
a curved surface with respect to the shroud, the ring preferably comprising:
two circular edges projecting radially and being positioned radially on the side of the shroud.

14. The stator according to claim 1, wherein the layer of abradable material comprises:
a resilient material with which the abradable material has been charged, and is intended to interact by abrasion with the rotor of the axial-flow turbomachine, the resilient material being chosen from the following group:
elastomer; and
silicone.

15. The stator according to claim 1, wherein the abradable layer forms a body between the ring and the shroud along the ring.

16. The stator according to claim 1, wherein the shroud comprises:
an annular surface facing the ring, the annular surface being radially spaced from the ring.

17. A compressor of an axial-flow turbomachine, comprising:
a stator comprising:
an outer casing;
an inner shroud having an annular row of openings and guiding an annular primary flow of the compressor;
an annular row of stator blades which extend essentially radially from the outer casing to the inner shroud and passing through the openings, each blade including an inner fixation extremity with retaining slot and a blade leaf extending in the primary flow of the compressor, each retaining slot including an inlet having a taper and being situated on the other side of the blade leaf in relation to the opening passed through by the corresponding blade; and
at least one retaining ring for blades inserted into the slots, the ring exhibiting the form of a strip having an arched transversal profile which is in contact with the tapers in such a way as to maintain the ring in the slots;
the arched transversal profile delimiting an outer space;
wherein the shroud comprises:
a layer of abradable material forming a block of material with a transversal profile encircling the transversal profile of the ring and filling the outer space in such a way as to block the curvature of the arched transversal profile in order to prevent the ring from exiting from the tapers of the slots by being deformed compressed axially, the abradable layer further enclosing the inner fixation extremities of the blades.

18. The compressor of claim 17, wherein the inner shroud is made of composite material with an organic matrix.

19. An axial-flow turbomachine, comprising:
a rotor; and
a stator comprising:
a shroud having an annular row of openings;
an annular row of stator blades which extend essentially radially by passing through the openings, each blade including a retaining slot and a blade leaf intended to extend in a flow of the turbomachine, each retaining slot including an inlet having a taper and being situated on the other side of the blade leaf in relation to the opening passed through by the corresponding blade; and
at least one retaining ring for blades inserted into the slots, the ring exhibiting the form of a strip having an arched transversal profile which is in contact with the tapers in such a way as to maintain the ring in the slots;
wherein the shroud comprises:
a layer of abradable material enclosing the transversal profile of the ring in such a way as to block the curvature of the arched transversal profile in order to prevent the ring from exiting from the tapers of the slots by arching further the arched transversal profile of the ring, the abradable layer comprising:
an annular surface around the rotor which is facing said rotor,
the slots are radially open, the radial depths of the slots being greater than the radial height of the ring.

20. The axial-flow turbomachine of claim 19, wherein the rotor comprises:
a seal with annular fins extending radially toward the abradable layer.

* * * * *